US006619448B1

(12) United States Patent
Wang

(10) Patent No.: US 6,619,448 B1
(45) Date of Patent: Sep. 16, 2003

(54) RETRACTABLE HANDLE FOR SUITCASE

(76) Inventor: King Sheng Wang, No. 16, Lane 116, Da An Gang Road, Da Gia Town, Taichung Hsien (TW), 437

( * ) Notice: Subject to any disclaimer, the term of this patent is extended or adjusted under 35 U.S.C. 154(b) by 0 days.

(21) Appl. No.: 10/144,219

(22) Filed: May 14, 2002

(51) Int. Cl.[7] ..... A45C 5/14

(52) U.S. Cl. ..... 190/115; 16/115; 190/18 A

(58) Field of Search ..... 190/115, 39, 18 A, 190/18 R; 16/113.1, 429, 405; 280/47.315, 47.371, 655, 655.1, 37

(56) References Cited

U.S. PATENT DOCUMENTS 5,628,088 A * 5/1997 Chen ..... 16/113.1
5,630,250 A * 5/1997 Chou ..... 16/113.1
5,630,488 A * 5/1997 Chen ..... 190/115
5,704,725 A * 1/1998 Horing ..... 403/109.3
5,806,143 A * 9/1998 Tsai ..... 16/405
5,810,132 A * 9/1998 Chang ..... 190/18 A
5,862,898 A * 1/1999 Chang ..... 190/115
5,864,921 A * 2/1999 Chou ..... 16/405
5,909,760 A * 6/1999 Tsai ..... 16/429
5,911,263 A * 6/1999 Wu ..... 16/429
6,338,587 B1 * 1/2002 Kuo ..... 403/109.7
6,339,863 B1 * 1/2002 Kuo ..... 16/113.1

* cited by examiner

*Primary Examiner*—Lee Young
*Assistant Examiner*—Lien Ngo

(57) ABSTRACT

A retractable handle includes two barrels secured in two ducts and each having a bore and a cut-off portion for forming two fences on the barrel, two tubes slidably received in the barrels, and a lock device having a housing attached to the lower end of one of the tubes. The housing includes one or more depressions for slidably receiving the fences of the barrel and for stably guiding the housing to move up and down along the barrel. The lock device includes a catch for selectively engaging with the barrel to secure the tube to the barrel.

16 Claims, 10 Drawing Sheets

RETRACTABLE HANDLE FOR SUITCASE

BACKGROUND OF THE INVENTION

1. Field of the Invention

The present invention relates to a handle, and more particularly to a retractable handle for suitcases.

2. Description of the Prior Art

Typical retractable handle for suitcases comprise a pair of telescopic tubes secured to the suitcase and extendible or retractable outward and inward of the suitcase, and a hand grip secured on top of the telescopic tubes for pulling the tubes inward and outward of the suitcase. The telescopic tubes normally include a tubular structure having a through hole formed within a solid and peripheral wall for receiving the latch devices that may be used to control the relatively sliding movement between the telescopic tubes. However, the through hole includes a tiny space or volume that the latch devices may not be easily engaged and assembled into the through holes of the tubular telescopic tubes.

The present invention has arisen to mitigate and/or obviate the afore-described disadvantages of the conventional retractable handles for suitcases.

SUMMARY OF THE INVENTION

The primary objective of the present invention is to provide a retractable handle having a barrel having an open space for easily receiving and assembling the lock devices to the barrel.

The other objective of the present invention is to provide a retractable handle including a telescopic structure that may include two or more segments extendible and retractable relative to each other.

In accordance with one aspect of the invention, there is provided a retractable handle for a suitcase, the retractable handle comprising a pair of ducts for securing to the suitcase, a pair of barrels secured in the ducts respectively, the barrels each including a bore formed therein, and a cut-off portion formed therein and communicating with the bore of the barrel for forming a pair of opposite fences thereon, a pair of tubes slidably received in the bores of the barrels respectively, and each including an upper end and a lower end, and each including a longitudinal direction, and a lock device including a housing attached to the lower end of a first of the tubes, the housing including a pair of longitudinal depressions formed therein for slidably receiving the fences of the barrel and for guiding the housing of the lock device to move up and down along the barrel, and the lock device including engaging means for selectively engaging with the barrel to secure the tube to the barrel. The longitudinal depressions of the housing may be used for stably receiving the fences of the barrel, for solidly and stably guiding the housing of the lock device to move or to slide along the fences of the barrel, and thus for solidly and stably guiding the tube to move or to slide along the barrel.

The barrel includes a rack secured therein and provided between the fences, the engaging means includes a gear secured in the housing and engaged with the rack for controlling a movement of the lock device relative to the tube.

The housing includes a chamber formed therein for receiving the gear, and a device is further provided for securing the gear to the housing and includes a bracket having at least one tooth for engaging with and for securing the gear to the housing. A spring may bias the tooth of the bracket to engage with the gear.

The bracket includes a first leg slidably received in the chamber of the housing and having the tooth provided thereon, and the bracket includes a second leg extended outward of the housing and slidably received in the lower end of the tube.

The bracket includes at least one link coupled between the first leg and the second leg of the bracket, and includes a gap formed between the fist leg and the second leg thereof, the housing includes a pair of tongues extended outward through the gap of the bracket, and a lid secured to the tongues and engaged with the bracket for securing the bracket to the housing.

A block is slidably received in the upper end of the first tube and coupled to the housing of the lock device for actuating the lock device, and movable in a moving direction parallel to or along the longitudinal direction of the tube, and includes an inclined surface formed therein, a hand grip includes a channel formed therein, and includes an end portion having a sleeve provided thereon, the sleeve is perpendicular to the hand grip and secured onto the upper end of the tube and parallel to the tube, and the sleeve includes a chamber formed therein and perpendicular to and communicating with the channel of the hand grip, a follower is slidably received in the channel of the hand grip, and movable in a direction perpendicular to the longitudinal direction of the tube and movable toward and away from the block, and includes a first end having an inclined surface formed therein for engaging with the inclined surface of the block, and for moving the block away from the sleeve and in a direction toward the lock device to actuate the lock device when the follower moves toward the block, and means for moving the follower toward the block to force the block to move along the tube and to actuate the lock device.

The moving means includes a bar slidably received in the hand grip and engaged with the follower for moving the follower to engage with the block.

The follower includes a second end having an inclined surface formed therein, the bar includes an inclined surface formed therein and engaged with the inclined surface of the second end of the follower for moving the follower toward and to engage with the block.

The hand grip includes an orifice formed therein, the bar includes a knob extendible outward through the orifice of the hand grip, for allowing the bar to be moved relative to the hand grip by depressing the knob. A spring may bias the knob of the bar outward of the hand grip.

A pair of conduits may further be provided and secured to the suitcase, the ducts are slidably received in the conduits respectively, and locking means for selectively locking the ducts to the conduits. The tubes are slidably received in the barrels and the ducts, such that the tubes and the ducts and the conduits may form a stable and a solid telescopic structure.

The locking means includes a second housing secured to a first of the ducts, a catch slidably received in the second housing, and means for biasing the catch to engage with a first of the conduit, and to selectively secure the first duct to the first conduit.

The first conduit includes at least one orifice formed therein, the second housing includes an aperture formed therein for selectively aligning with the orifice of the first conduit and for slidably receiving the catch, for allowing the catch to be engaged into the orifice of the first conduit.

The catch includes at least one projection extended therefrom, the locking means includes an actuator slidably engaged in the second housing and having at least one inclined surface formed therein for engaging with the projection of the catch and for moving the catch against the biasing means.

A spring biasing device may further be provided for biasing the actuator relative to the catch and to disengage the inclined surface of the actuator away from the projection of the catch.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 11:
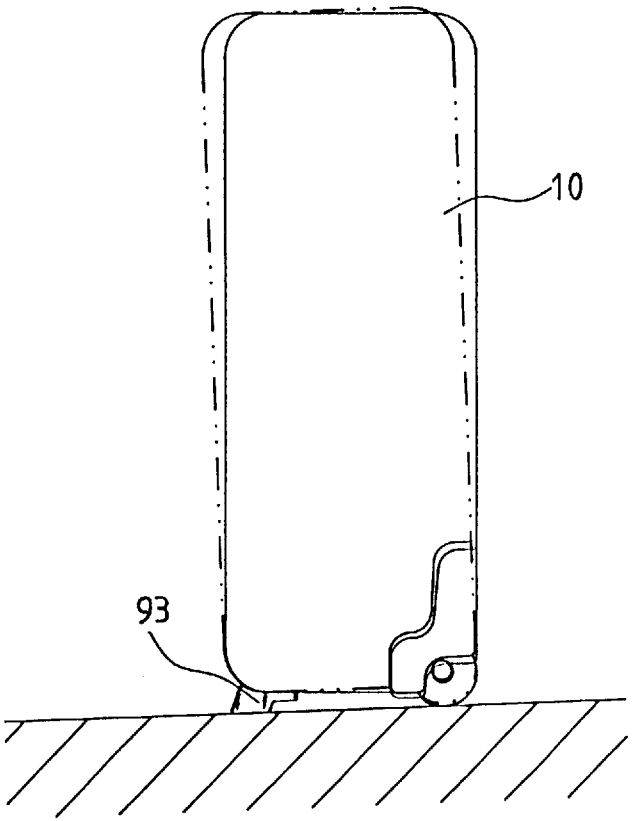
FIG. 11 is a side schematic view illustrating the operation of the suitcase.
Figure 12:
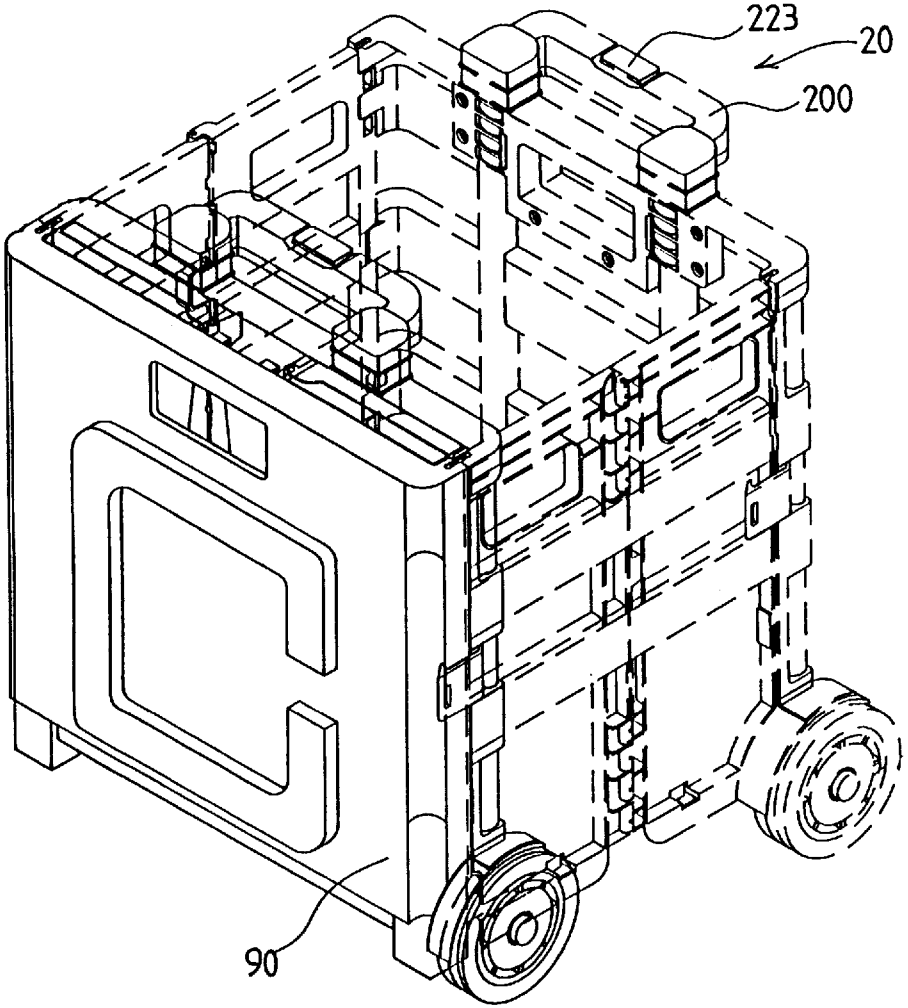
FIGS. 12, 13, 14 are perspective views illustrating the applications or the arrangements or the attachments of the retractable handle onto the other objects.
Figure 13:
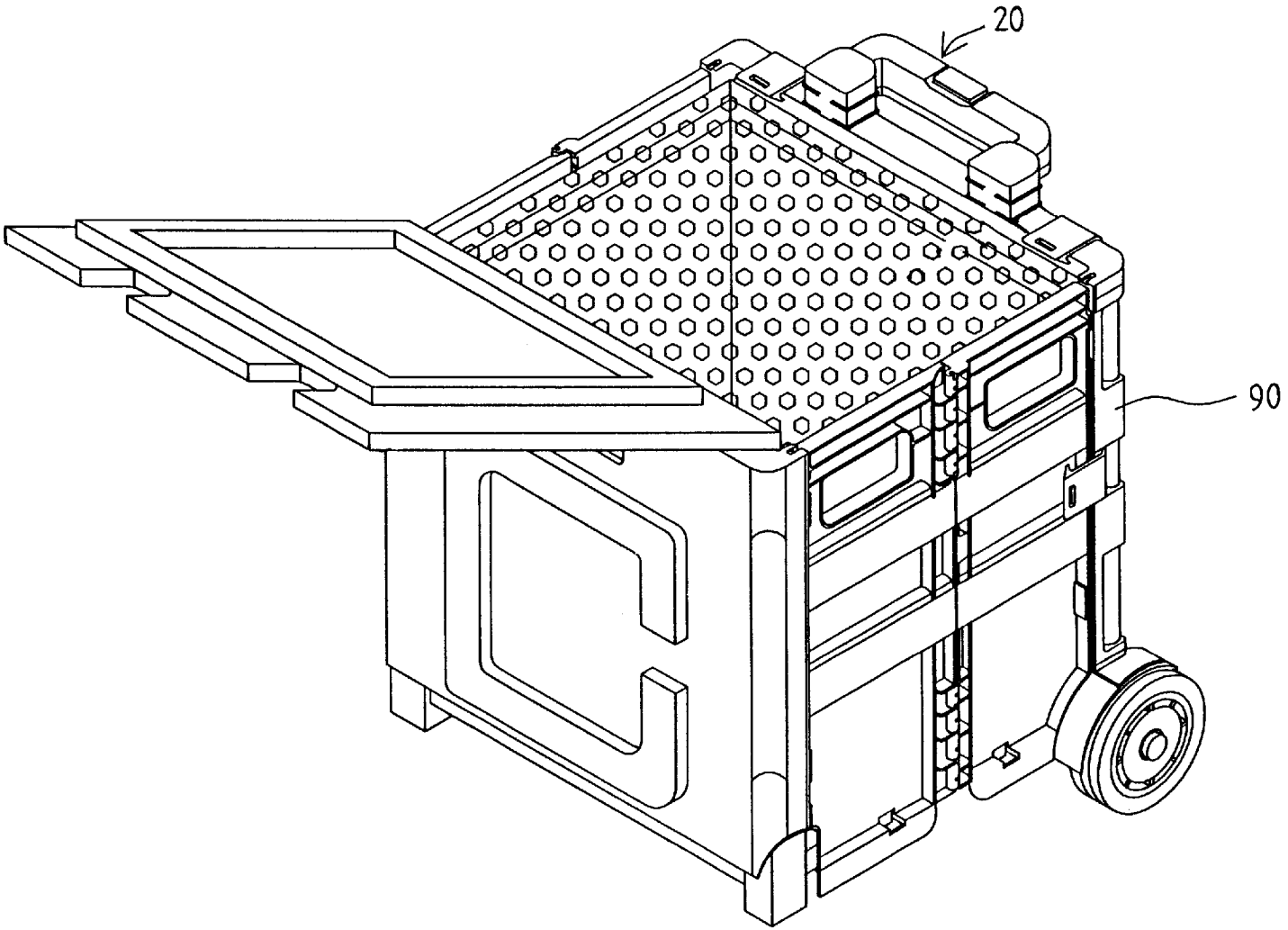
Figure 14:
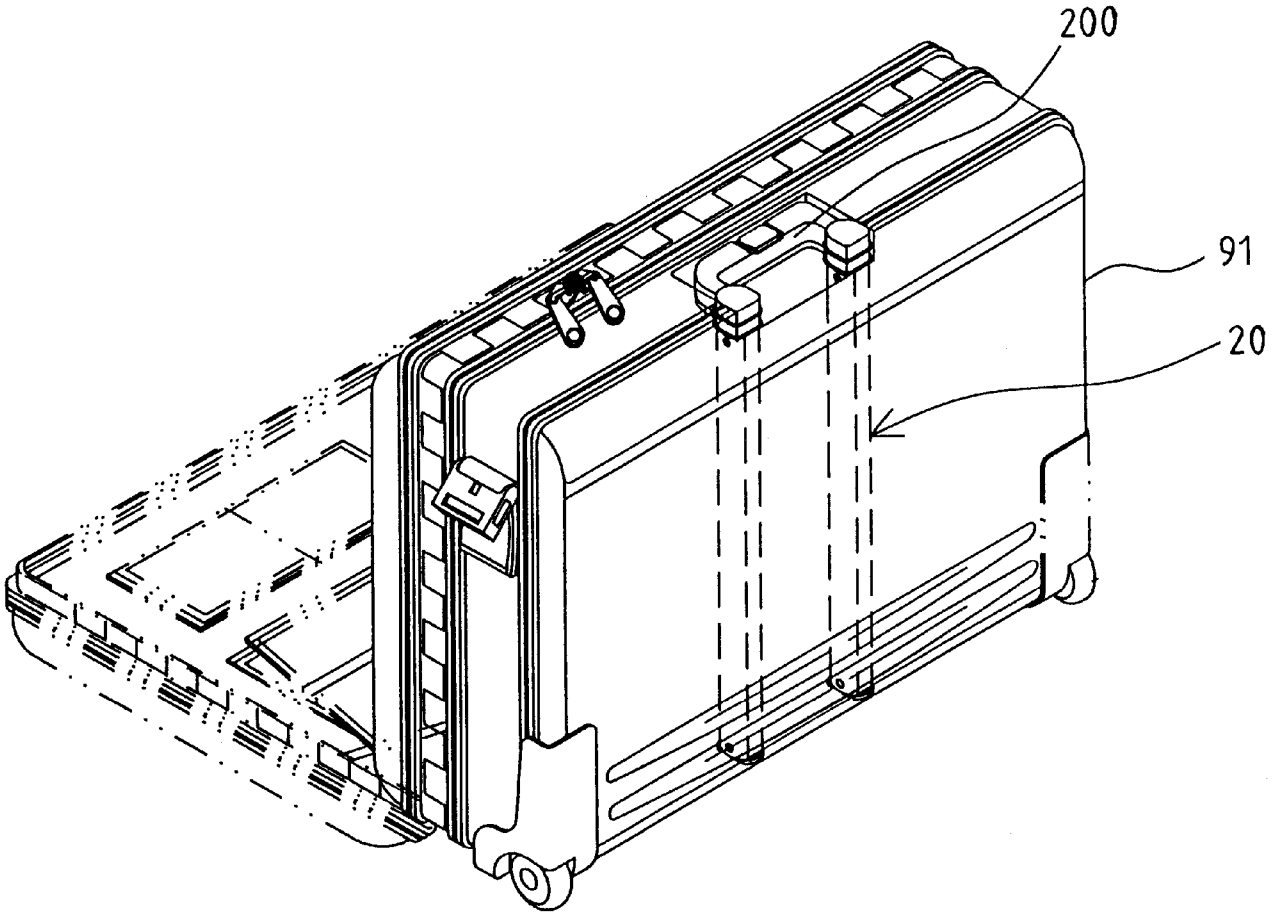

Referring to the drawings, and initially to FIGS. 1–3, 5 and 6, a retractable handle 20 in accordance with the present invention is provided for attaching onto or into a suitcase 10. Similarly, the retractable handle 20 may also be attached or secured into or onto the tool retainers 90 as shown in FIGS. 12, 13, or may be attached or secured into or onto the other objects, such as the luggage apparatus 91 as shown in FIG. 14. A foot pad 93 (FIGS. 1, 11) or the like may be attached to the bottom of the suitcase 10 for supporting the suitcase 10 at a suitable upright position.

The suitcase 10 includes a cavity 17 formed in the upper portion thereof, particularly formed in the front and upper portion thereof for receiving a hand grip 200 of the retractable handle 20. The retractable handle 20 comprises one or more, particularly two conduits 16 secured on or in the suitcase 10, and two ducts 11 slidably and adjustably secured in the conduits 16 respectively. The ducts 11 each includes a bore 12 formed therein and each includes two holes 14 formed in the upper and the lower portions thereof.

The retractable handle 20 includes two barrels 50 engaged in the bores 12 of the ducts 11 respectively, and each having a bore 51 formed therein, and each having a rack 52 secured to the barrel 50 and extended or provided in the bore 51 of the barrel 50, and each having a spring biased latch 53 provided thereon for engaging into the upper hole 14 of the duct 11 and for securing the barrel 50 in the duct 11. The barrel 50 includes a peripheral flange 57 extended laterally outward from the top thereof for engaging with the duct 11 and for securing the barrel 50 to the duct 11.

Figure 1:
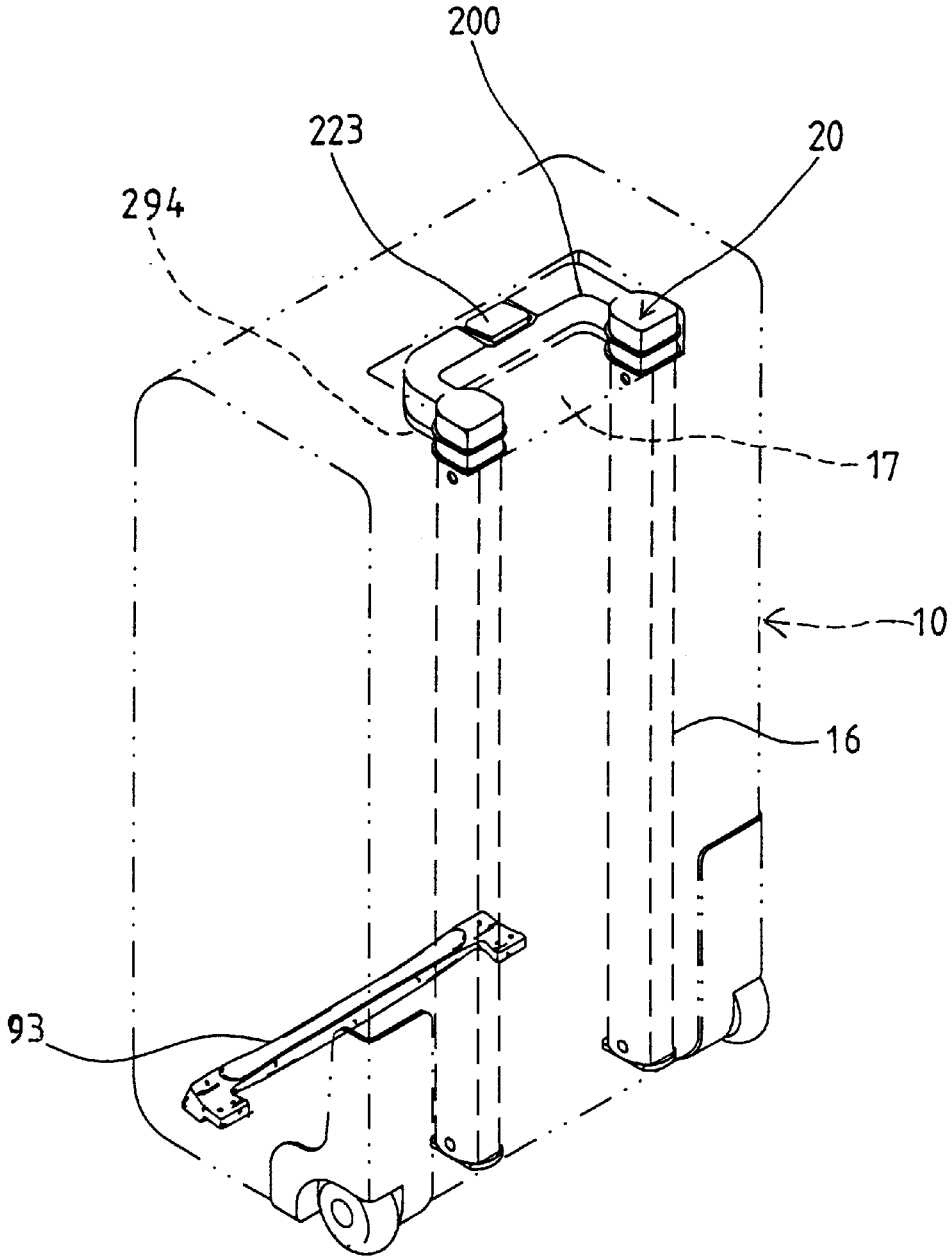
FIG. 1 is a perspective view of a suitcase having a retractable handle in accordance with the present invention.
Figure 2:
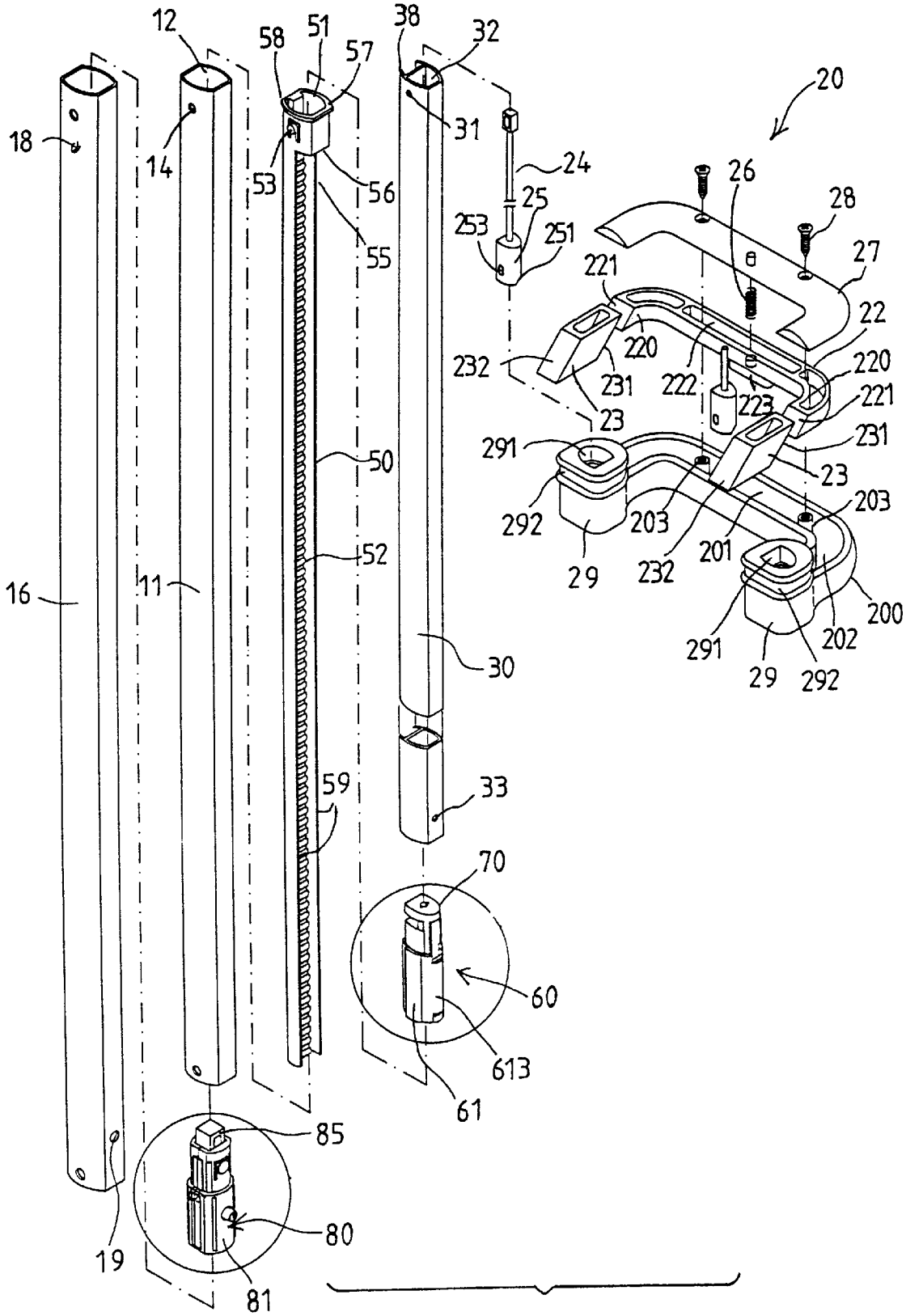
FIG. 2 is an exploded view of a hand grip of the retractable handle for the suitcase.
Figure 3:
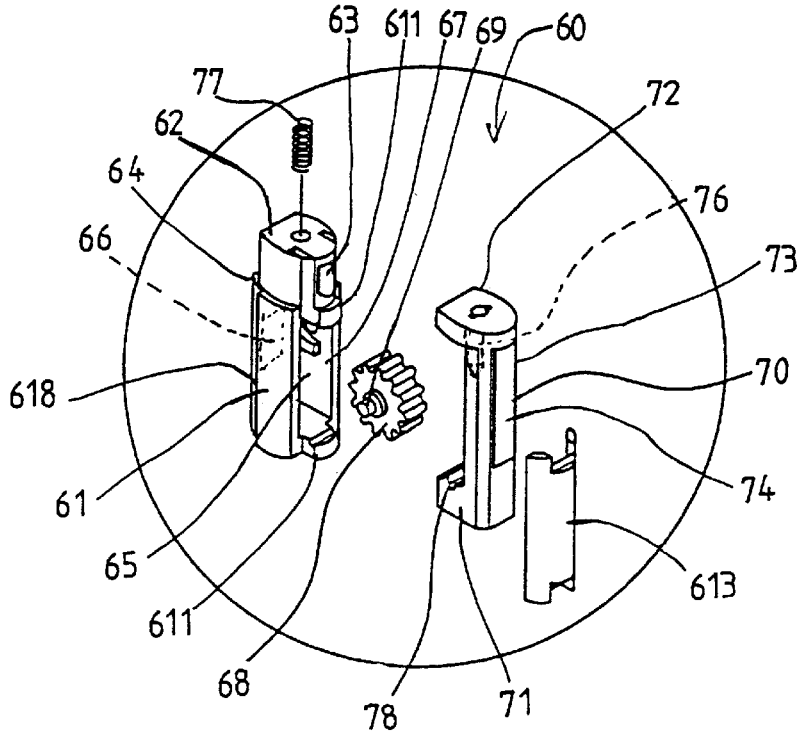
FIG. 3 is a partial exploded view illustrating one of the lock devices of the retractable handle for the suitcase.
Figure 4:
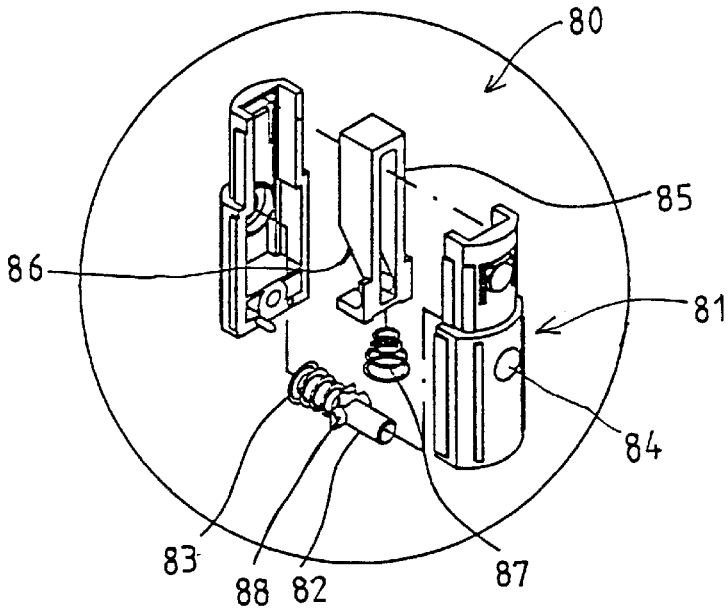
FIG. 4 is a partial exploded view illustrating the other lock device of the retractable handle for the suitcase.
Figure 6:
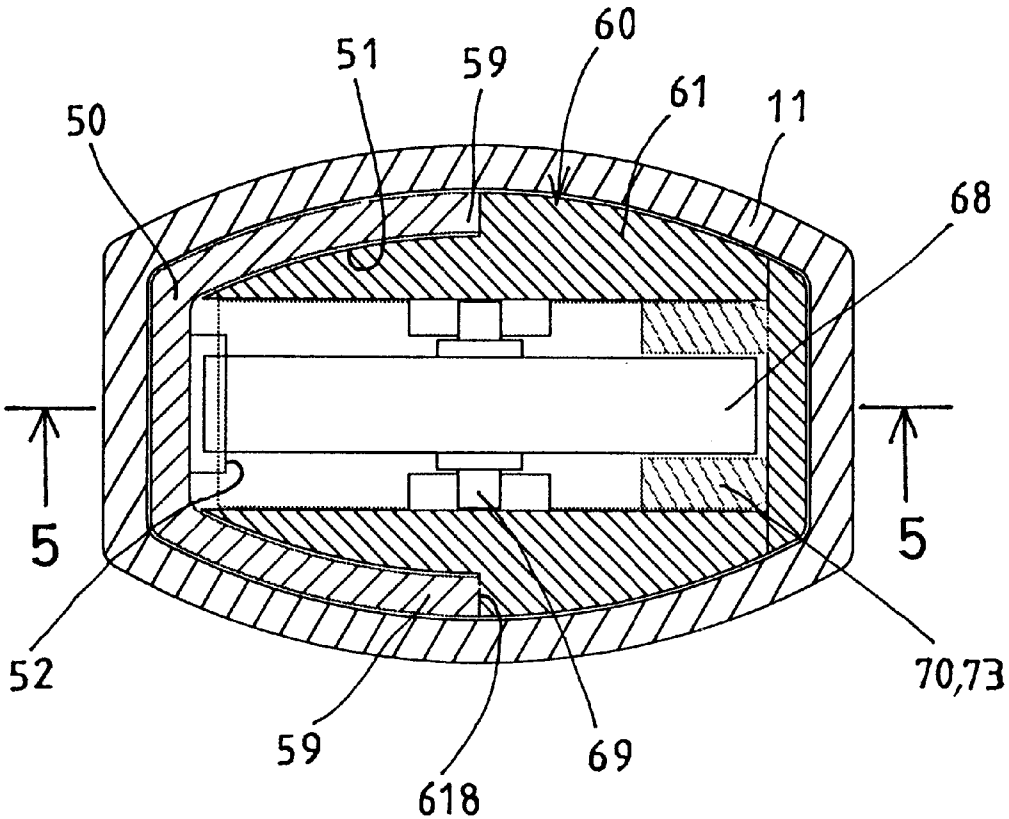
FIG. 6 is a cross sectional view taken along lines 6—6 of FIG. 5.

The barrel 50 includes a cut-off portion 55 for forming or defining a shoulder 56 in the upper portion thereof, and for forming or defining a pair of fences 59 in the side portions thereof and located on the sides of or beside the rack 52, best shown in FIGS. 2, 6. Two longitudinal grooves 58 are formed in the barrel 50 and located between the rack 52 and the fences 59. The cut-off portion 55 of the barrel 50 is formed or provided in almost the length of the barrel 50, except the upper portion of the barrel 50, for allowing the rack 52 to be exposed and to be easily reached by the other elements or members.

The retractable handle 20 includes two tubes 30 slidably received in the bores 51 of the barrels 50 respectively, and each having an aperture 31 formed in the upper portion thereof for receiving a fastener or a shaft 293 (FIGS. 5, and 7–9), and each having a bore 32 formed therein, and each having one or more holes 33 formed in the lower portion thereof. The tubes 30 each includes one or more longitudinal flanges 38 slidably engaged in the longitudinal grooves 58 of the barrel 50, for stably guiding the tube 30 to slide longitudinally relative to the barrel 50 respectively.

The tubes 30 are extendible or movable inward and outward of the barrels 50 and the ducts 11 respectively, and the ducts 11 are extendible or movable inward and outward of the conduits 16, such that the tubes 30 and the ducts 11 and the conduits 16 form a pair of retractable handle members. A lock device 60 is provided for selectively or adjustably securing the tubes 30 to the ducts 11, and another lock device 60 is provided for selectively or adjustably securing the ducts 11 to the conduits 16, and will be described hereinafter.

The retractable handle 20 includes a U-shaped hand grip 200 arranged or disposed perpendicular to the tubes 30 and having a U-shaped space formed or defined by a passage 201 and two channels 202, and having one or more studs 203 extended inward of the passage 201 thereof. Two sleeves 29 are secured to the ends of the hand grip 200, and each includes a chamber 291 formed therein and perpendicular to and communicating with the channels 202 of the hand grip 200 respectively, and each includes a pipe 292 extended downward beyond the hand grip 200 and engaged onto the tubes 30 respectively, and secured to the tubes 30 with the fasteners or shafts 293, such that a gap 294 (FIG. 1) may be formed between the hand grip 200 and the suitcase 10, and such that the hands of the users may be engaged into the gap 294 to grasp the hand grip 200.

It is to be noted that the hand grip 200 is perpendicular to the sleeves 29 and the tubes 30, and the channels 202 of the hand grip 200 are also perpendicular to the chambers 291 of the sleeves 29 and perpendicular to the tubes 30 respectively. A U-shaped bar 22 is slidably received in the passage 201 and the channels 202 of the hand grip 20, and includes two ends 220 each having an inclined surface 221 formed therein, and includes a slot 222 formed therein for slidably receiving the studs 203 and for allowing the bar 22 to be slidably received in the passage 201 and the channels 202 of the hand grip 20.

The bar 22 includes a knob 223 extended upward therefrom and extendible upward and outward through an orifice 204 of the hand grip 200 (FIGS. 5, 7), for allowing the bar 22 to be depressed and moved downward and inward of the hand grip 200. The U-shaped bar 22 may thus be guided to slide up and down along the passage 201 and the channels 202 of the hand grip 20, and slidable in a direction parallel to the longitudinal directions of the tubes 30.

Two followers 23 are slidably received in the channels 202 of the hand grip 200 and partially slidable inward of the chambers 291 of the sleeves 29 respectively, and each includes an inclined surface 231 formed in one end thereof for slidably engaging with the inclined surface 221 of the bar 22 and for allowing the followers 23 to be moved toward or inward and outward of the chambers 291 of the sleeves 29 respectively when the bar 22 is moved upward and downward relative to the hand grip 200. The followers 23 may thus be laterally moved in a direction perpendicular to the sleeves 29 and the tubes 30. The followers 23 each includes an inclined surface 232 formed in the other end thereof and slidably received in the chambers 291 of the sleeves 29 respectively.

One or both of the tubes 30 each includes a rod 24 slidably received therein and movable up and down relative to the tube 30, and each includes a block 25 secured on top of the rod 24 and moved in concert with the rod 24. The blocks 25 each includes an inclined surface 251 formed in the upper end thereof for slidably engaging with the inclined surface 232 of the follower 23 and for allowing the blocks 25 and thus the rods 24 to be moved upward and downward relative to the tubes 30 when the followers 23 are moved inward and outward of the chambers 291 of the sleeves 29 respectively. The blocks 25 each includes an oblong hole 253 formed therein for slidably receiving the shafts 293 respectively and for limiting the upward and downward movement of the blocks 25 and the rods 24 relative to the tubes 30.

Accordingly, the blocks 25 and the rods 24 may thus be actuated and moved upward and downward along the tubes 30 by the upward and downward movement of the bar 22 relative to the hand grip 200, and by the lateral movement of the followers 23. The blocks 25 and the rods 24 may thus be moved in a direction perpendicular to the moving direction of the followers 23, and parallel to the moving direction of the bar 22. The moving direction of the bar 22 is also perpendicular to the moving direction of the followers 23. A cap 27 may be secured to the bottom portion of the hand grip 200 with fasteners 28, for enclosing the passage 201 and the channels 202 of the hand grip 200 and for stably retaining the bar 22 and the followers 23 within the hand grip 200. A spring 26 (FIG. 2) may be provided and engaged between the bar 22 and the hand grip 200 for biasing the hand grip 200 upward and for biasing the knob 223 of the bar 22 upward and outward through the orifice 204 of the hand grip 200.

As shown in FIGS. 2, 3, and 5–9, one or both of the tubes 30 each includes a lock device 60 attached to the lower end thereof. The lock device 60 includes a housing 61 having an extension 62 of smaller diameter provided or extended on top thereof, for forming a peripheral shoulder 64 between the housing 61 and the extension 62, and for engaging with the shoulder 56 of the barrel 50, and for preventing the housing 61 and thus the tube 30 from being disengaged from the barrel 50. The housing 61 includes a pair of longitudinal depressions 618 formed therein for slidably receiving the fences 59 of the barrel 50 (FIG. 6) and thus for solidly and stably guiding the housing 61 to move up and down along the barrel 50.

The extension 62 is engaged into the lower end of the bore 32 of the respective tube 30, and includes one or more depressions 63 formed therein for receiving spring biased catches (FIGS. 5, 7–9) or fasteners that are engaged through the holes 33 of the tube 30 and for securing the housings 61 to the lower ends of the tubes 30 respectively. The housing 61 includes a chamber 65 formed therein, and includes an aperture 66 and an opening 67 formed therein and opposite to each other, and communicating with the chamber 65 thereof.

A gear 68 is rotatably received and secured in the chamber 65 of the housing 61 with a pivot axle 69, and partially extended outward of the aperture 66 of the housing 61 for engaging with the rack 52 of the barrel 50. A bracket 70 includes a lower leg 71 slidably received in the chamber 65 of the housing 61, and an upper leg 72 provided above the housing 61 and slidably received in the tube 30, and one or more links 73 secured between the legs 71, 72, and a gap 74 formed in or between the links 73. The housing 61 includes a pair of tongues 611 extended therefrom and extended through the gap 74 of the bracket 70. A lid 613 is secured to the tongues 611 and engaged with the bracket 70 for slidably securing the bracket 70 to the housing 61 and for allowing the bracket 70 to be slided up and down relative to the housing 61.

The brackets 70 are secured to the lower ends of the rods 24 respectively, and moved in concert with the rods 24 respectively, such that the brackets 70 may be caused to move up and down relative to the housing 61. The brackets 70 each includes one or more teeth 78 formed or provided on the lower leg 71 thereof for engaging with the gear 68, and each includes a pin 76 extended downward from the upper leg 72 and extended toward the housing 61. A spring 77 is engaged on the pin 76 and engaged between the housing 61 and the bracket 70 for biasing the teeth 78 of the bracket 70 to engage with the gear 68 and to lock the gear 68 and the housing 61 and the bracket 70 to the barrel 50, and thus for locking the tube 30 to the barrel 50 and the duct 11 (FIGS. 5, 9).

Figure 5:
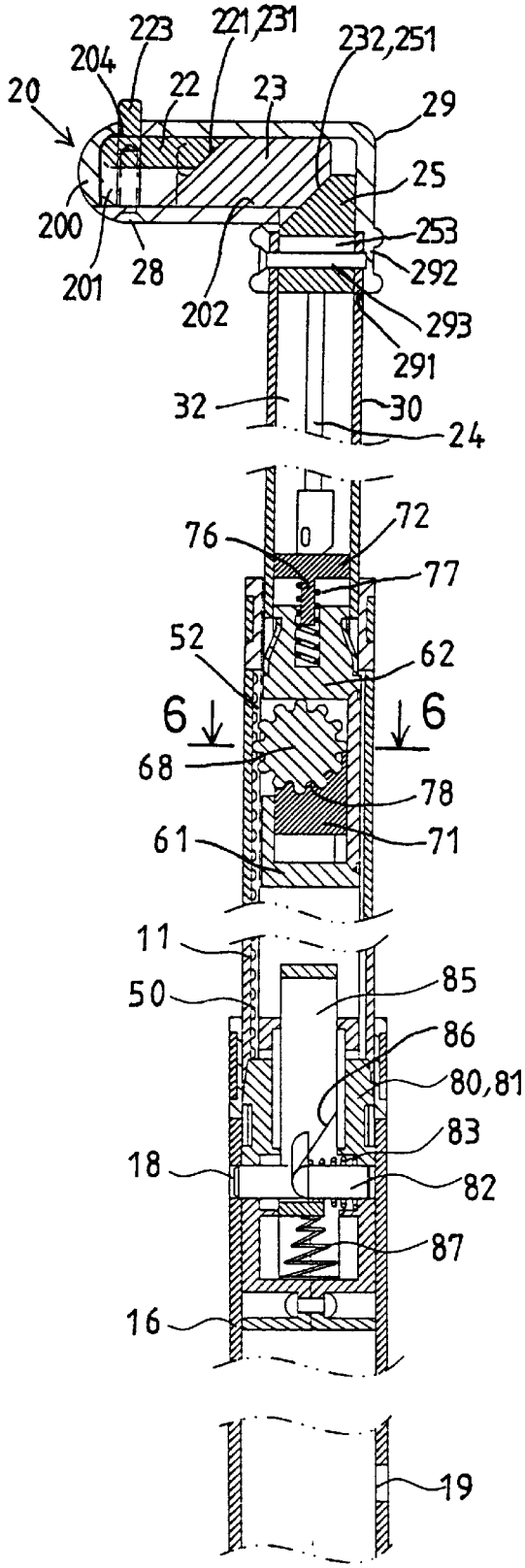
FIG. 5 is a partial cross sectional view taken along lines 5—5 of FIG. 6.
Figure 9:
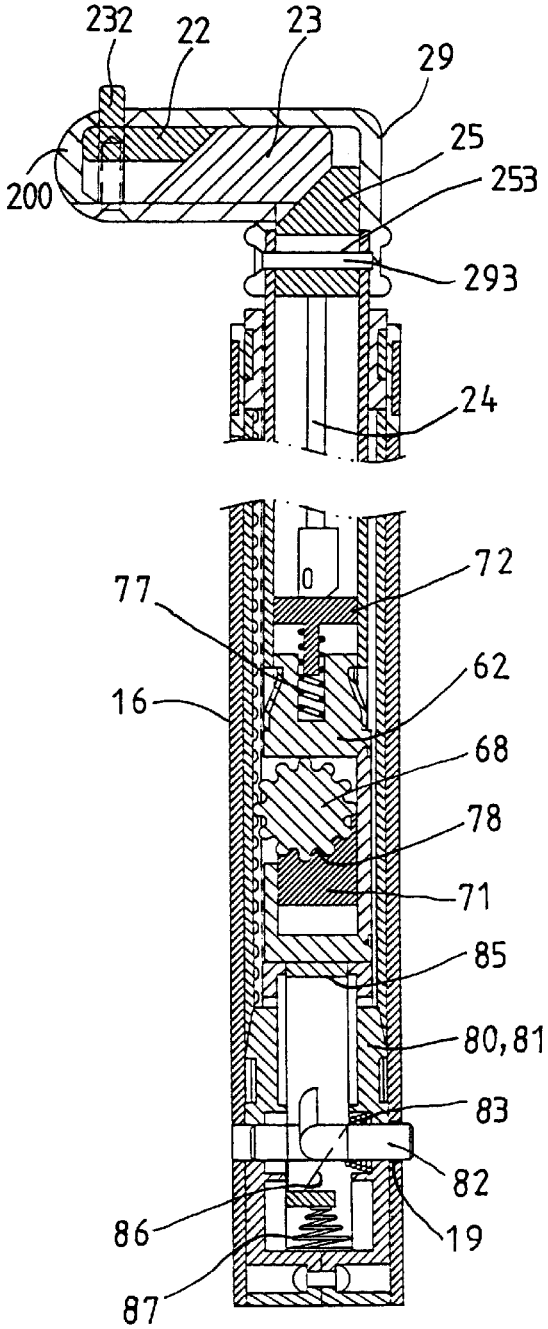

As shown in FIGS. 5, 9, when the teeth 78 of the bracket 70 are caused or biased to engage with the gear 68, the gear 68 may be retained and locked in place by the bracket 70 and thus may not be rotated relative to the housing 61 and may not be rotated relative to the rack 52 of the barrel 50. The gear 68 and thus the housing 61 and the bracket 70 may thus be locked to the barrel 50. The teeth 78 of the bracket 70 may be disengaged from the gear 68 to unlock or to release the gear 68 and the housing 61 from the barrel 50 when the bracket 70 is moved toward the housing 61 against the spring 77 by the rod 24 and the block 25. The gear 68 may be rotated or moved along the rack 52 of the barrel 50 when the teeth 78 of the bracket 70 may be disengaged from the gear 68 (FIGS. 7, 8).

Figure 7:
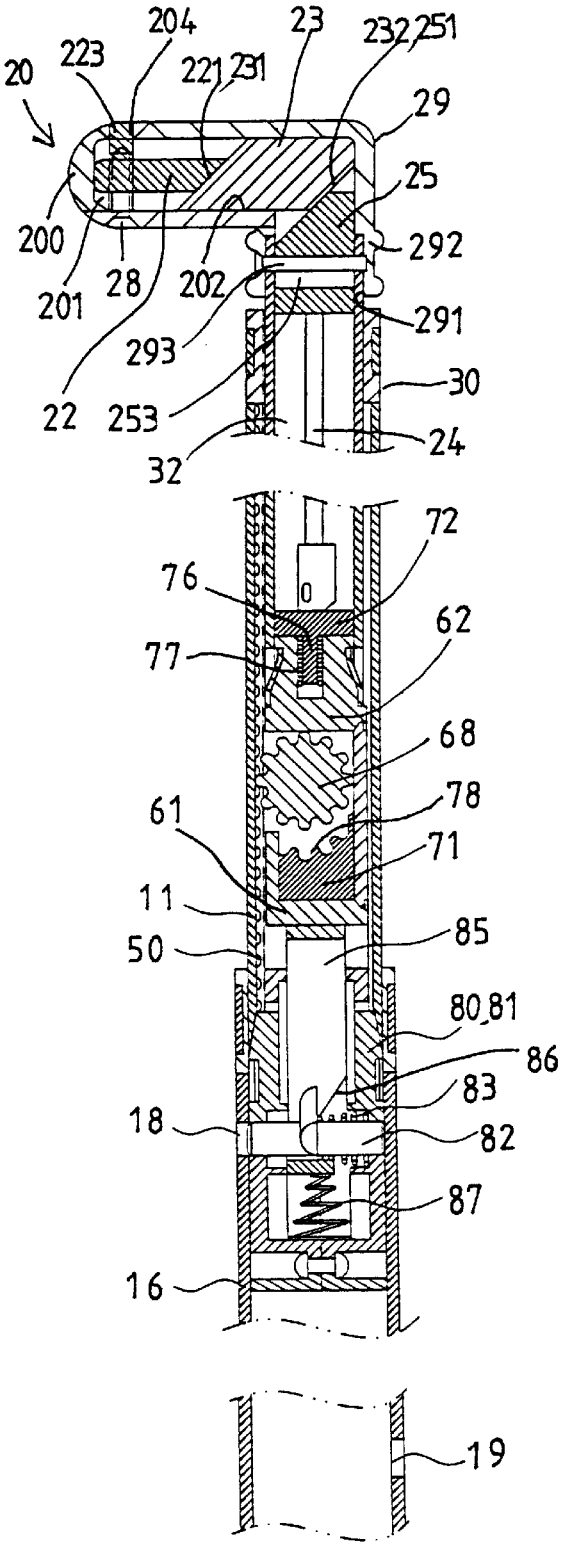
FIGS. 7, 8, 9 are partial cross sectional views similar to FIG. 5, illustrating the operation of the retractable handle for the suitcase.
Figure 8:
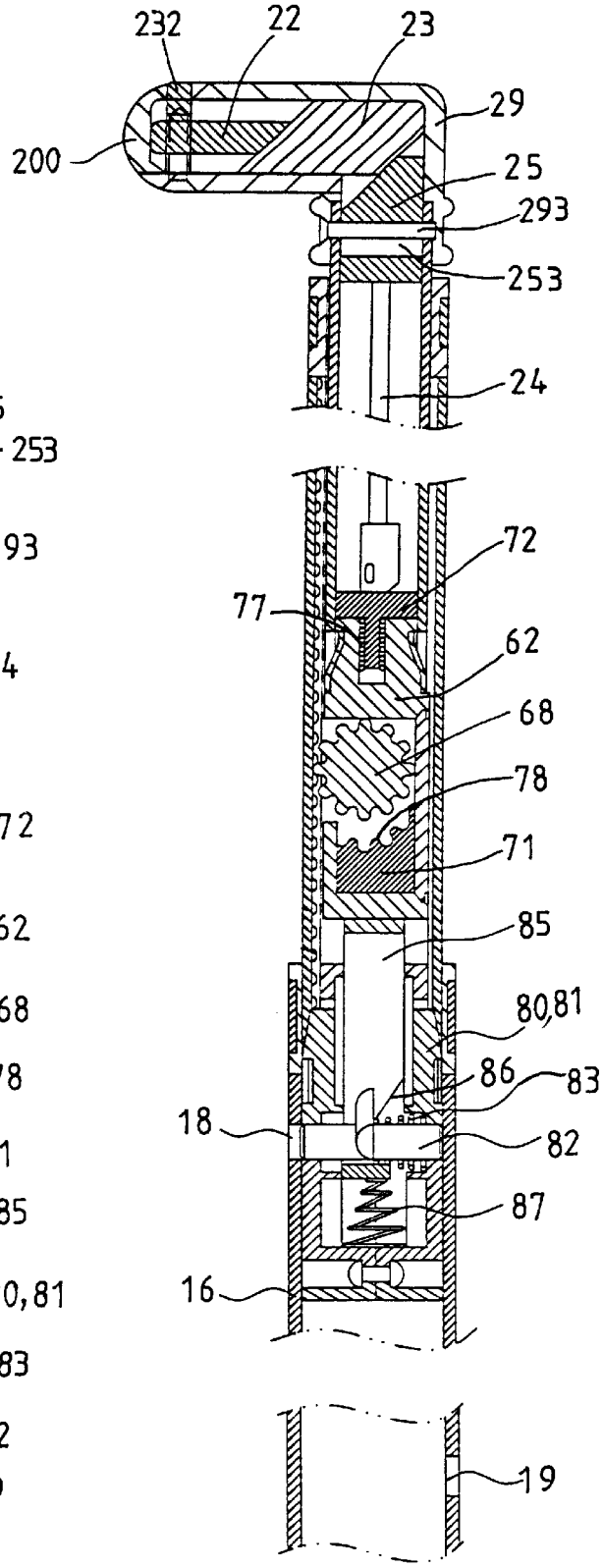

In operation, as shown in FIG. 7, when the knob 223 of the bar 22 is depressed downward and inward of the hand grip 200, the follower 23 may be forced to move away from the bar 22 and may be moved in a direction perpendicular to the moving direction of the bar 22. The block 25 and thus the rod 24 may then be forced to move downward along the tube 30 by the sliding engagement between the inclined surfaces 232, 251 of the follower 23 and the block 25, in order to force and to move the bracket 70 relative to the housing 61, and to disengage the teeth 78 from the gear 68, and thus to release the gear 68. The gear 68 may thus be moved relative to the rack 52 of the barrel 50 when the tube 30 is pulled and moved relative to the barrel 50 and the duct 11, and such that the tube 30 may be moved inward and outward of the duct 11.

The teeth 78 of the bracket 70 may be forced to engage with the gear 68 and to lock the gear 68 to the housing 61 by the spring 77 when the knob 223 is released. The spring 26 (FIG. 2) may be used for biasing the bar 22 upward relative to the hand grip 200. Without the spring 26, the bar 22 may also be moved upward relative to the hand grip 200 by the follower 23 and the block 25 when the block 25 and the rod 24 are moved or biased upward relative to the tube 30 by the spring 77 that is shown in FIGS. 5 and 9.

As shown in FIGS. 2, 4, 5 and 7–9, the other lock device 80 may be used for selectively locking the ducts 11 to the conduits 16 respectively, and includes a housing 81 made or formed by two half members which may be secured together by fasteners or with adhesive materials, or by welding processes. The upper end of the housing 81 may be secured to the lower end of the duct 11, such that the housing 81 and the duct 11 move in concert with each other relative to the conduit 16. A catch 82 is laterally and slidably received in the housing 81 and extendible outward through an aperture 84 of the housing 81, and a spring 83 may be engaged with the catch 82 for biasing the catch 82 to engage with either of the orifices 18, 19 that are formed in the upper and the lower portions of the conduit 16 respectively, and for selectively and adjustably locking the ducts 11 to the conduits 16.

An actuator 85 is slidably received in the housing 81, and includes one or more inclined surfaces 86 formed therein for engaging with the projections 88 of the catch 82 and for moving the catch 82 against the spring 83. A spring 87 is engaged between the actuator 85 and the housing 81 for biasing and disengaging the inclined surfaces 86 of the actuator 85 from the projections 88 of the catch 82.

In operation, as shown in FIG. 7, when the duct 11 is extended outward of the conduit 16 and when the actuator 85 has not been depressed or actuated against the spring 87, the spring 87 may bias and disengage the inclined surfaces 86 of the actuator 85 from the projections 88 of the catch 82, such that the catch 82 may be biased to engage with the upper orifice 18 of the conduits 16, and such that the ducts 11 may be maintained in the outward extending position relative to the conduits 16 by the catches 82. The catch 82 may be disengaged from the upper orifice 18 of the conduit 16 when the actuator 85 is depressed or actuated inward of the housing 81 against the spring 87.

As shown in FIG. 9, when the duct 11 is extended outward of the conduit 16 and when the actuator 85 is depressed or actuated downward against the spring 87, for example, by the housing 61 of the lock device 60, the inclined surfaces 86 of the actuator 85 may engage with the projections 88 of the catch 82, and may move the catches 82 against the springs 83, such that the other end of the catch 82 may be forced to engage with the lower orifice 19 of the conduit 16, and such that the ducts 11 may be maintained in the inward receiving position relative to the conduits 16 by the catches 82.

Figure 10:
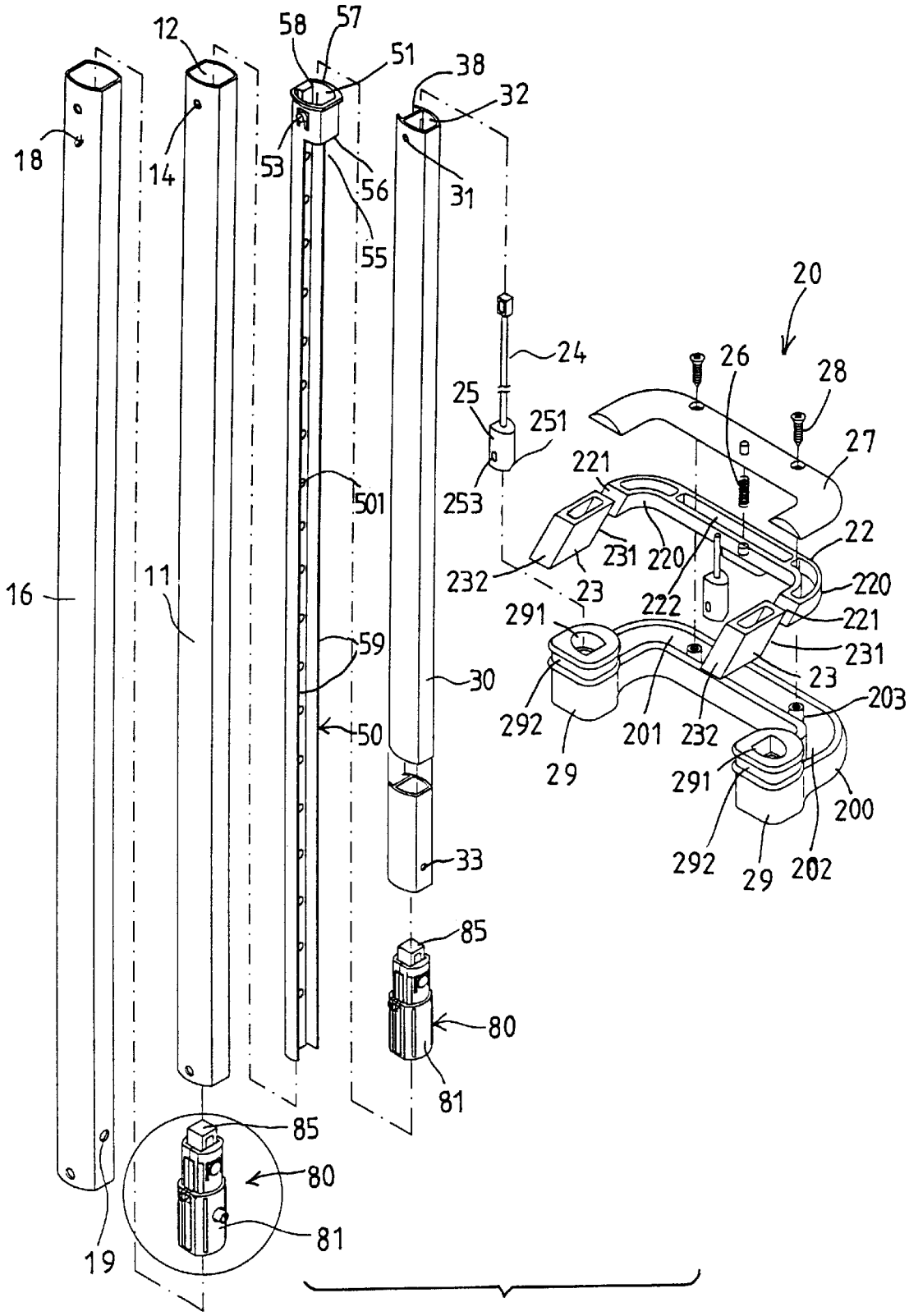
FIG. 10 is an exploded view similar to FIG. 2, illustrating the other arrangement of the hand grip for the retractable handle of the suitcase.

Referring next to FIG. 10, alternatively, the barrel 50 may include a number of apertures 501 formed along the length thereof, instead of the rack 52, for selectively or changeably receiving the catches 82 of the lock device 80, which thus may also be used for selectively and adjustably locking the tube 30 to the barrel 50 and the duct 11.

Accordingly, the retractable handle in accordance with the present invention includes a barrel having an open space for easily receiving and assembling the lock devices, and/or includes a telescopic structure that may include two or more segments extendible and retractable relative to each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A retractable handle for a suitcase, said retractable handle comprising:

a pair of ducts for securing to the suitcase, a pair of barrels secured in said ducts respectively, said barrels each including a bore formed therein, and a cut-off portion formed therein and communicating with said bore of said barrel for forming a pair of opposite fences thereon, a pair of tubes slidably received in said bores of said barrels respectively, and each including an upper end and a lower end, and each including a longitudinal direction, a lock device including a housing attached to said lower end of a first tube of said tubes, said housing including a pair of longitudinal depressions formed therein for slidably receiving said fences of said barrel and for guiding said housing of said lock device to move up and down along said barrel, and said lock device including engaging means for selectively engaging with said barrel to secure said first tube to said barrel, a block slidably received in said upper end of said first tube and coupled to said housing of said lock device for actuating said lock device, and movable in a moving direction parallel to or along said longitudinal direction of said tube, and including an inclined surface formed therein, a hand grip including a channel formed therein, and including an end portion having a sleeve provided thereon, said sleeve being perpendicular to said hand grip and secured onto said upper end of said first tube and parallel to said first tube, and said sleeve including a chamber formed therein and perpendicular to and communicating with said channel of said hand grip, a follower slieably received in said channel of said hand grip, and movable in a direction perpendicular to said longitudinal direction of said tube and movable toward and away from said block, and including a first end having an inclined surface formed therein for engaging with said inclined surface of said block, and for moving said block away from said sleeve and in a direction toward said lock device to actuate said lock device when said follower moves toward said block, and means for moving said follower toward said block to force said block to move along said tube and to actuate said lock device.

2. The retractable handle according to claim 1, wherein said barrel includes a rack secured therein and provided between said fences, said engaging means includes a gear secured in said housing and engaged with said rack for controlling a movement of said lock device relative to said tube.

3. The retractable handle according to claim 2, wherein said housing includes a chamber formed therein for receiving said gear, and means for securing said gear to said housing.

4. The retractable handle according to claim 3, wherein said securing means includes a bracket having at least one tooth for engaging with and for securing said gear to said housing.

5. The retractable handle according to claim 4 further comprising means for biasing said at least one tooth of said bracket to engage with said gear.

6. The retractable handle according to claim 4, wherein said bracket includes a first leg slidably received in said chamber of said housing and having said at least one tooth provided thereon, and said bracket includes a second leg extended outward of said housing and slidably received in said lower end of said tube.

7. A retractable handle for a suitcase, said retractable handle comprising:

a pair of ducts for securing to the suitcase, a pair of barrels secured in said ducts respectively, said barrels each including a bore formed therein, and a cut-off portion formed therein and communicating with said bore of said barrel for forming a pair of opposite fences thereon, and a rack secured therein and provided between said fences, a pair of tubes slidably received in said bores of said barrels respectively, and each including an upper end and a lower end, and each including a longitudinal direction, a lock device including a housing attached to said lower end of a first tube of said tubes, said housing including a pair of longitudinal depressions formed therein for slidably receiving said fences of said barrel and for guiding said housing of said lock device to move up and down along said barrel, said lock device including engaging means for selectively engaging with said barrel to secure said first tube to said barrel, said engaging means including a gear secured in said housing and engaged with said rack for controlling a movement of said lock device relative to said tube, said housing including a chamber formed therein for receiving said gear, and means for securing said gear to said housing, said securing means including a bracket having at least one tooth for engaging with and for securing said gear to said housing, said bracket including a first leg slidably received in said chamber of said housing and having said at least one tooth provided thereon, and said bracket including a second leg extended outward of said housing and slidably received in said lower end of said tube, and said bracket including at least one link coupled between said first leg and said second leg of said bracket, and including a gap formed between said first leg and said second leg thereof, said housing including a pair of tongues extended outward through said gap of said bracket, and a lid secured to said tongues and engaged with said bracket for securing said bracket to said housing.

8. The retractable handle according to claim 1, wherein said moving means includes a bar slidably received in said hand grip and engaged with said follower for moving said follower to engage with said block.

9. The retractable handle according to claim 8, wherein said follower includes a second end having an inclined surface formed therein, said bar includes an inclined surface formed therein and engaged with said inclined surface of said second end of said follower for moving said follower toward and to engage with said block.

10. The retractable handle according to claim 8, wherein said hand grip includes an orifice formed therein, said bar includes a knob extendible outward through said orifice of said hand grip, for allowing said bar to be moved relative to said hand grip by depressing said knob.

11. The retractable handle according to claim 10 further comprising means for biasing said knob of said bar outward of said hand girp.

12. The retractable handle according to claim 1 further comprising a pair of conduits for securing to the suitcase, said ducts being slidably received in said conduits respectively, and locking means for selectively locking said ducts to said conduits.

13. The retractable handle according to claim 12, wherein said locking means includes a second housing secured to a first of said ducts, a catch slidably received in said housing, and means for biasing said catch to engage with a first of said conduit, and to selectively secure said first duct to said first conduit.

14. The retractable handle according to claim 13, wherein said first conduit includes at least one orifice formed therein, said second housing includes an aperture formed therein for selectively aligning with said at least one orifice of said first conduit and for slidably receiving said catch, for allowing said catch to be engaged into said at least one orifice of said first conduit.

15. The retractable handle according to claim 13, wherein said catch includes at least one projection extended therefrom, said locking means includes an actuator slidably engaged in said second housing and having at least one inclined surface formed therein for engaging with said at least one projection of said catch and for moving said catch against said biasing means.

16. The retractable handle according to claim 15 further comprising means for biasing said actuator relative to said catch and to disengage said at least one inclined surface of said actuator away from said at least one projection of said catch.

* * * * *